United States Patent [19]

Pasternak

[11] 4,298,062

[45] Nov. 3, 1981

[54] HEAT EXCHANGERS AND METHOD OF MAKING SAME

[75] Inventor: Stephen F. Pasternak, Park Rige, Ill.

[73] Assignee: Peerless of America, Inc., Chicago, Ill.

[21] Appl. No.: 970,438

[22] Filed: Dec. 18, 1978

[51] Int. Cl.[3] ..... F28F 1/14

[52] U.S. Cl. ..... 165/181; 29/157.3 A

[58] Field of Search ..... 113/118; 29/157.3 R, 29/157.3 B; 165/181–183, 163

[56] References Cited

U.S. PATENT DOCUMENTS

| | | | |
|---|---|---|---|
| 3,495,657 | 2/1970 | Keith | 165/183 |
| 3,868,994 | 3/1975 | Petrek | 122/32 |
| 3,947,941 | 4/1976 | O'Connor et al. | 29/157.3 B |
| 3,991,823 | 11/1976 | Litke et al. | 165/163 |

FOREIGN PATENT DOCUMENTS

| | | | |
|---|---|---|---|
| 432936 | 8/1935 | United Kingdom | 165/181 |

*Primary Examiner*—Samuel Scott
*Assistant Examiner*—Theophil W. Streule, Jr.
*Attorney, Agent, or Firm*—Emrich, Root, Lee, Brown & Hill

[57] ABSTRACT

A heat exchanger embodying an elongated tubular member having a passageway for working fluid extending longitudinally therethrough, and having external fins projecting outwardly from the tubular member in position of define passageways extending transversely thereacross, and the method of making the same.

33 Claims, 15 Drawing Figures

HEAT EXCHANGERS AND METHOD OF MAKING SAME

BACKGROUND OF THE INVENTION

This invention relates to heat exchangers, and, more particularly, to tubular heat exchangers having external fins thereon for defining passageways extending transversely thereacross.

It is a primary object of the present invention to enable a novel heat exchanger to be afforded in a novel and expeditious manner.

Another important object of the present invention is to afford a novel, externally-finned, tubular heat exchanger.

A further object of the present invention is to afford a novel tubular heat exchanger having external fins projecting outwardly from diametrically opposed sides thereof.

Tubular heat exchangers having external fins, and even tubular heat exchangers having fins projecting outwardly from diametrically opposed sides thereof, have been heretofore known in the art, being shown, for example, in U.S. Pat. Nos. 3,202,212, issued to R. W. Kritzer on Aug. 24, 1965; 3,229,722, issued to R. W. Kritzer on Jan. 18, 1966; 3,692,105, issued to J. M. O'Connor on Sept. 19, 1972; 3,746,086, issued to me on July 17, 1973; and 3,877,517, issued to me on Apr. 15, 1975. Heat exchangers of the types disclosed in the aforementioned patents have proven to be very effective. However, it is an object of the present invention to afford improvements over heat exchangers of the type disclosed in the aforementioned patents.

Another object of the present invention is to afford a novel, externally-finned, tubular heat exchanger wherein the parts thereof are constituted and arranged in a novel and expeditious manner.

An object ancillary to the foregoing is to afford a novel heat exchanger of the aforementioned type wherein turbulence is imparted in a novel and expeditious manner to working fluid passing through the interior of the tubular member.

Another ancillary object is to afford a novel heat exchanger of the aforementioned type wherein turbulence is imparted, in a novel and expeditious manner, to air or other working fluid flowing across the exterior of the tubular member, between the fins thereon, transversely to the length of the tubular member.

Another object of the present invention is to enable the heat transfer between working fluid passing longitudinally through an elongated heat exchanger and working fluid passing transversely across the exterior of the heat exchanger to be increased in a novel and expeditious manner.

Another object of the present invention is to afford a novel externally-finned, elongated, tubular heat exchanger wherein the interior of the tubular portion is undulating, in a novel and expeditious manner, longitudinally thereof to afford a turbulent passage of working fluid longitudinally therethrough, with the fluid being directed first in one direction and then in the opposite direction into wiping or scrubbing contact with respective opposite, internal sidewall portions of the tubular member.

Yet another object of the present invention is to afford a novel, externally-finned, elongated, tubular heat exchanger wherein the external fins extend across the tubular member in a direction transversely to the length of the latter, with adjacent pairs of fins defining passageways for the flow of air transversely across the heat exchanger, and with adjacent passageways being disposed at different angles relative to each other and to the length of the tubular member.

A further object of the present invention is to enable a novel tubular member, embodying a passageway for working fluid extending longitudinally therethrough, and embodying external fins on the exterior thereof, to be afforded in a novel and expeditious manner, with the interior passageway undulating in a novel and expeditious manner, or with the external fins being disposed in a novel and expeditious manner relative to each other, or with both the novel passageway construction and the novel fin disposition.

Another object of the present invention is to afford a novel, externally, finned, elongated tubular heat exchanger, wherein the fins thereof project outwardly from two, substantially diametrically opposite sides of the tubular member, and wherein both the tubular member and the fins thereon, along the lengths of the tubular member, undulate back and forth in one direction and then in the opposite direction transverse to the length of the tubular member and transverse to the direction that the fins on opposite sides of the tubular member project outwardly from the latter.

A further object of the present invention is to afford a novel heat exchanger of the last mentioned type, wherein the fins at opposite sides of the center portions of individual ones of the aforementioned undulations are disposed at progressively changing angles, transversely to the length of the tubular member.

Another object of the present invention is to enable a novel tubular heat exchanger, embodying a substantially straight portion having external fins thereon defining adjacent passageways which are disposed at progressively different angles to each other and to the length of the substantially straight portion, to be afforded in a novel and expeditious manner.

Another object of the present invention is to afford a novel externally-finned, tubular heat exchanger having the aforementioned undulations therealong, wherein the interior of the tubular member is divided into a plurality of passageways for the passage of working fluid longitudinally through the tubular member.

An object ancillary to the foregoing is to afford a novel tubular heat exchanger, of the aforementioned type, wherein the passageways are displaced from each other in the same direction as the tubular member undulates.

A further ancillary object is to afford a novel heat exchanger of the aforementioned type, wherein the passageways at the convex side of each such undulation are of greater cross-sectional size than that of the passageways at the concave side of said undulation.

A further object of the present invention is to afford a novel method of making a novel heat exchanger.

Another object of the present invention is to afford a novel externally-finned heat exchanger which is practical and efficient in operation and which may be readily and economically produced commercially.

Other and further objects of the present invention will be apparent from the following description and claims and are illustrated in the accompanying drawings which, by way of illustration, show preferred embodiments of the present invention and the principles thereof and what I now consider to be the best mode in which I have contemplated applying these principles. Other embodiments of the invention embodying the same or equivalent principles may be used and structural changes may be made as desired by those skilled in the art without departing from the present invention and the purview of the appended claims.

DESCRIPTION OF THE EMBODIMENTS SHOWN HEREIN

Figure 1:
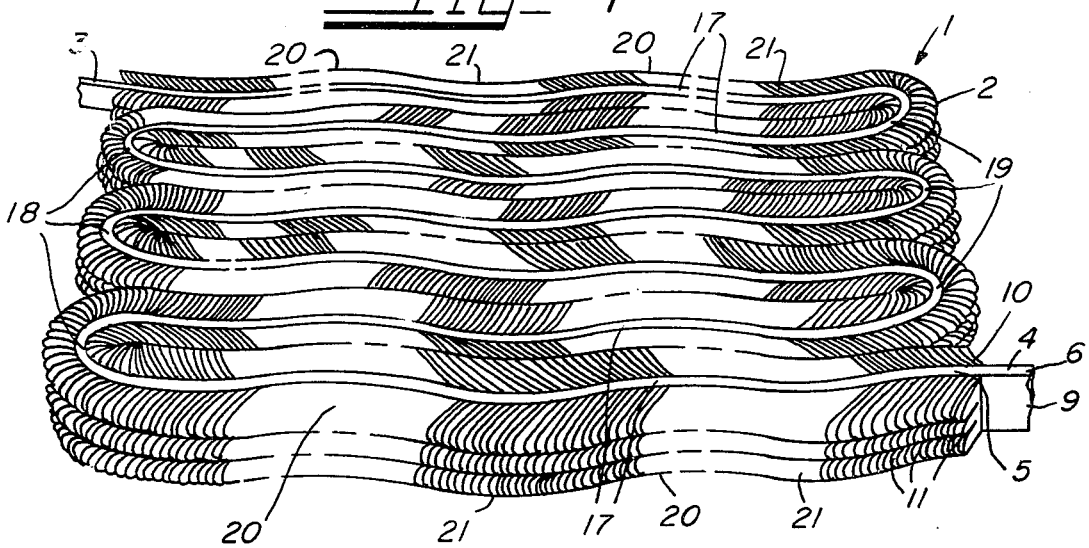
FIG. 1 is a perspective view of a heat exchanger embodying the principles of the present invention.
Figure 2:
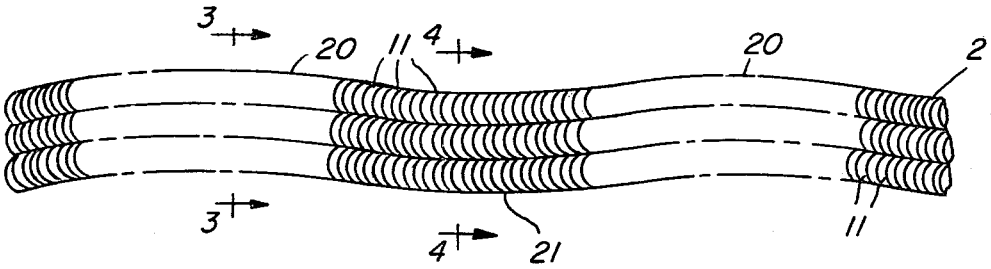
FIG. 2 is a fragmentary, side elevational view of the heat exchanger in FIG. 1.

A tubular heat exchanger or heat transfer element 1 is shown in FIGS. 1–6 of the drawings to illustrate the presently preferred embodiment of the present invention.

The heat exchanger 1 embodies a body portion 2, which, in the preferred embodiment of the present invention, comprises a one-piece, externally-finned tubular member bent back and forth upon itself into a serpentine pattern. The tubular member 2 has end portions 3 and 4 at the respective ends thereof for use as connecting members at each end of the completed heat exchanger 1.

Figure 3:
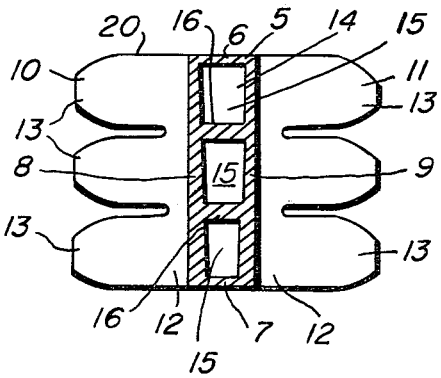
FIG. 3 is a detail sectional view taken substantially along the line 3—3 in FIG. 2.
Figure 4:
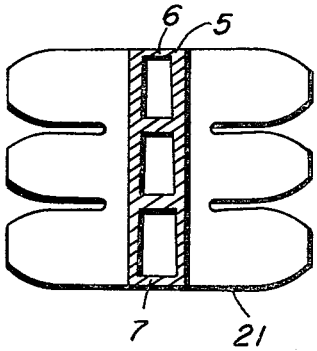
FIG. 4 is a detail sectional view taken substantially along the line 4—4 in FIG. 2.

The tubular member 2 embodies an elongated conduit 5, which preferably is substantially rectangular in transverse cross-section, FIGS. 3 and 4, having two substantially parallel, narrower opposite side walls 6 and 7 and two oppositely disposed, substantially parallel wider side walls 8 and 9. A plurality of fins 10 and 11 project outwardly from the outer faces of the side walls 8 and 9, respectively, and are disposed in spaced relation to each other longitudinally of the conduit 5. The fins 10 and 11 may be of any suitable form without departing from the purview of the broader aspects of the present invention, but, preferably, are elongated fins having longitudinally extending base portions 12 extending transversely across the outer faces of the side walls 8 and 9, in adjacent relation thereto, with a plurality of spines, such as the spines 13 projecting outwardly from the outer longitudinal edge portions of the respective base portions 12.

Preferably, the fins 10 and 11 are integral to or with the side walls 8 and 9. They may be formed in any suitable manner, but, preferably, are formed by cutting or gouging them out of the side walls 8 and 9, respectively, of the conduit 5 in the manner disclosed in the aforementioned U.S. Pat. No. 3,692,105, while the conduit 5 is substantially straight throughout its length.

It is to be observed that, when the term "integral" is used herein relative to the relationship of the fins 10 and 11 to the conduit 5, it is intended to denote that the fins 10 and 11 are formed integrally with or from the conduit 5 in a suitable manner, such as, for example, in a suitable forming process or by cutting or gouging the fins 10 and 11 from the conduit 5, as previously discussed, and as distinguished from fins that are applied and secured to a conduit such as, for example, by welding or soldering, or the like.

The conduit 5 has a passageway 14 extending longitudinally therethrough for the passage of a suitable working fluid, such as, for example, a refrigerant or hot liquid, or the like, longitudinally through the conduit 5. Preferably, the passageway 14 comprises a plurality of openings or passageways 15 spaced across the wider width of the conduit 5, with adjacent ones of the passageways 15 being separated from each other by suitable partition walls 16 extending between the side walls 8 and 9, FIGS. 3 and 4.

In the presently preferred method of making the heat exchanger 1, after the conduit 5 has been afforded with the fins 10 and 11, it is bent back and forth upon itself around the side walls 8 and 9, respectively, to afford the body portion 2 in the form of the aforementioned serpentine-shaped, externally-finned tubular member. In this latter form of the body portion 2, it embodies a plurality of passes or conduit members 17 disposed in side-by-side, substantially parallel relation to each other with return bends 18 and 19 interconnecting adjacent ends of adjacent ones of the passes 17 at respective opposite ends of the latter, FIG. 1.

In this preliminary form of the body portion 2, the fins 10 and 11 on each of the adjacent passes 17 preferably are disposed in closely adjacent, nearly abutting relation to the fins 10 and 11, respectively, on the next adjacent pass 17; and the body portion 2 is substantially flat.

Thereafter, in the preferred method of making the heat exchanger 1, while holding the ends of the passes 17 against movement toward or away from each other, undulations 20 and 21, which are convex outwardly in the direction of the side walls 6 and 7 of the conduit 5, respectively, are formed in the passes 17, between the aforementioned end portions thereof, by a suitable forming operation. The undulations 20 and 21 may be of various sizes and shapes, but, preferably, are relatively smooth, such as, for example, in the nature of a sine curve, and preferably, the oppositely projecting undulations 20 and 21 are so disposed relative to each other that they afford a relatively smooth wave, such as, for example, a wave in the nature of a sine wave.

With the heat exchanger 1 constructed in the aforementioned manner, the forming of the undulations 20 and 21 therein causes the fins 10 and 11, along the arcs of the undulations, to be displaced relative to each other. Thus, for example, when the fins 10 and 11 are originally formed on the substantially flat, straight conduit 5 in parallel, spaced relation to each other in position to extend perpendicular to the length of the conduit 5, the passageways 22 defined by each pair of adjacent fins 10 or 11 in the straight conduit 5 are substantially straight and uniform in transverse cross section and are parallel to each other and perpendicular to the length of the conduit 5. After the undulations 20 and 21 have been made in the passes 17 of the body portion 2, the position of adjacent passageways 22, in the passes 17, have been changed relative to each other, and the included angle between adjacent pairs of the fins 10 or 11, defining respective ones of the passageways 22 have been changed.

Figure 5:
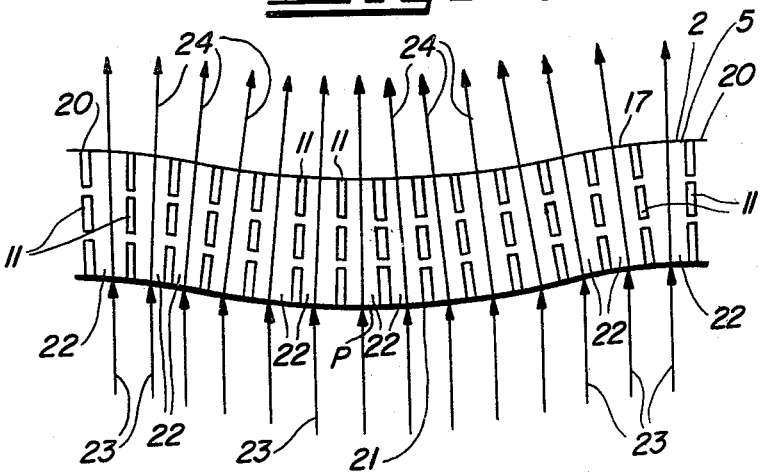
FIG. 5 is a diagrammatic view illustrating the position of the external fins relative to each other with respect to their positions along the undulations in the tubular member.

Thus, as illustrated somewhat diagrammatically in FIG. 5, if the undulations 20 and 21 are so formed in the passes 17 that one passageway 22 is disposed at the exact center position of each of the undulations 20 and 21, such as the undulation 22 shown at the position P in the undulation 21 shown in FIG. 5, these centermost passageways 22 remain disposed perpendicular to the length of the heat exchanger 1, between the return bends 18 and 19. However, although these centermost passageways 22 remain perpendicular to the length of the heat exchanger 1, the included angle between the respective pairs of adjacent fins 10 or 11 defining these last mentioned passageways is changed, changing from a parallel relation to an acute angle, opening outwardly away from the concave side toward the convex side of each of the undulations 20 and 21, FIG. 5.

However, the forming of the undulations 20 and 21 causes the other passageways 22 in each undulation, to be changed from its original position wherein it was disposed perpendicular to the aforementioned length of the heat exchanger 1 to a position wherein it is substantially aligned with the radial center of the arc of the respective undulation 20 or 21. Thus, as illustrated in FIG. 5 with respect to an undulation 21, the passageways 22 on both sides of the aforementioned centermost passageway 22 in each of the undulations are disposed at a progressively greater angle relative to the centermost passageway 22 throughout the length of the respective undulation 20 or 21, the angles of the passageways 22 on the opposite sides of the centermost passageway 22 being oppositely opening angles relative thereto.

Furthermore, like the included angle between the pairs of fins defining the centermost passageways 22, each of the included angles between the pairs of fins defining the passageways 22 disposed at opposite sides of the centermost passageways 22 is changed from a substantially parallel relation between the pairs of fins to an acute angle opening outwardly from the concave side toward the convex side of each of the undulations 20 and 21.

As will be appreciated by those skilled in the art the showing of the centermost passageways 22 exactly centered on the undulations 20 and 21 is merely by way of illustration of the relative positioning of various parts of the heat exchanger 1 to each other. As a practical matter it is doubtful if, in the commercial production of heat exchangers, such as the heat exchanger 1, the centermost passageways 22 will be exactly centered relative to the undulations 20 and 21. However, even when the centermost passageways 22 are not exactly so centered, but are somewhat displaced from the exact centers of the undulations 20 and 21, the principle of operation and the varying positioning of the adjacent passageways 22 along the undulations 20 and 21 remains the same.

With the heat exchanger 1 constructed in the aforementioned manner, when air or other working fluid is pushed or drawn through the heat exchanger 1 transversely to the passes 17 such as, for example, from the bottom to the top of the heat exchanger 1, as viewed in FIG. 1, the air, which is entering the heat exchanger 1 in a direction perpendicular thereto, as illustrated by the arrows 23 in FIG. 5, is deflected at an acute angle to that perpendicular direction during its passage through all the passageways 22, except those passageways 22 that may happen to be disposed exactly at the center of the respective undulations 20 and 21, as illustrated by the arrows 24 in FIG. 5. As a result, a turbulence is set up in the air passing through these offset passageways 22, and the air passing through these passageways 22 is caused to impinge against the fins 10 or 11 defining the respective passageways, and to contact these fins with a wiping action. This, alone, is effective to afford an increased heat exchange between the air passing through the passageways 22 and the passes 17 of the heat exchanger 1, as compared to heat exchangers wherein the passageways therethrough are in alignment with the direction of the air entering the heat exchanger. In effect, such construction affords the increased heat transfer capacity of a larger finned tube 2, without increasing the tube size.

Figure 6:
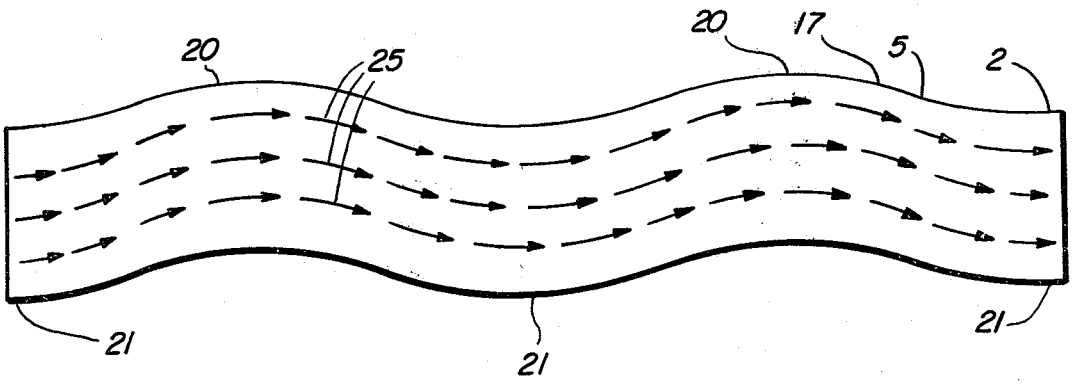
FIG. 6 is a diagrammatic view illustrating the flow paths of fluid longitudinally through the heat exchanger, relative to the undulations therein.

Also, the aforementioned construction of the heat exchanger 1 increases the turbulence of the working fluid passing through the passageways 15, this working fluid passing through the passes 17 of the conduit 5 in an undulating path, as diagrammatically illustrated by the arrows 25 in FIG. 6. The increased turbulence of the working fluid passing through the passageways 15 mixes the fluid and tends to increase the heat transfer between the fluid and the conduit 5. In addition, the undulating flow of the working fluid through the conduit 5 causes it to be thrown outwardly, back and forth into wiping contact with one side and then the opposite side of the portions of the conduit 5 defining passageways 15, so that not only is the turbulence of the working fluid increased, as it flows through the conduit 5, but, this turbulent, mixed working fluid is, in effect, pressed into firm contact with the sides of the passageways against which it is directed.

Also, as illustrated in FIGS. 3 and 4, the forming of the undulations 20 and 21 causes the cross sectional size of the passageway 14, which it will be remembered in the preferred form of the invention shown in the drawings embodies a plurality of passageways 15, to be increased in cross sectional size at the outer or convex portions of the respective undulations 20 and 21 and to be decreased in cross sectional size at the inner or concave portions of the undulations 20 and 21. This has the additional advantage over straight-line conduits, insofar as increasing the heat transfer between a working fluid and the conduit through which it is passing, that one side and then other of the passageway 14 through the conduit is alternately restricted to thereby increase the force with which the fluid engages that side of the conduit. However, at the same time, the other side of the conduit, against which the fluid is being thrown, is of expanded cross sectional size so that the restriction to the overall flow of working fluid through the passes 17 is not substantially increased, if at all.

Although in the preferred form of the invention shown in FIGS. 1–6, the passes 17 are so bent that they undulate first in one direction and then the other, it will be appreciated by those skilled in the art that this is merely by way of illustration, and not by way of limitation, and that other forms of undulations, such as, for example, undulations projecting only in one direction from an otherwise straight conduit could be afforded without departing from the purview of the broader aspects of the present invention.

Also, although the heat exchanger 1, shown in the drawings, is illustrated as embodying the return bends 18 and 19, and is shown as embodying a plurality of passes 17, this is merely by way of illustration of the presently preferred form of the present invention, and not by way of limitation, and other forms of construction, such as, for example, with the passes 17 constituting individual conduit members connected into suitable headers by suitable means such as welding or soldering, or the like; and heat exchangers can be afforded which embody only one tubular member, such as an individual one of the passes 17, without departing from the purview of the broader aspects of the present invention.

Figure 7:
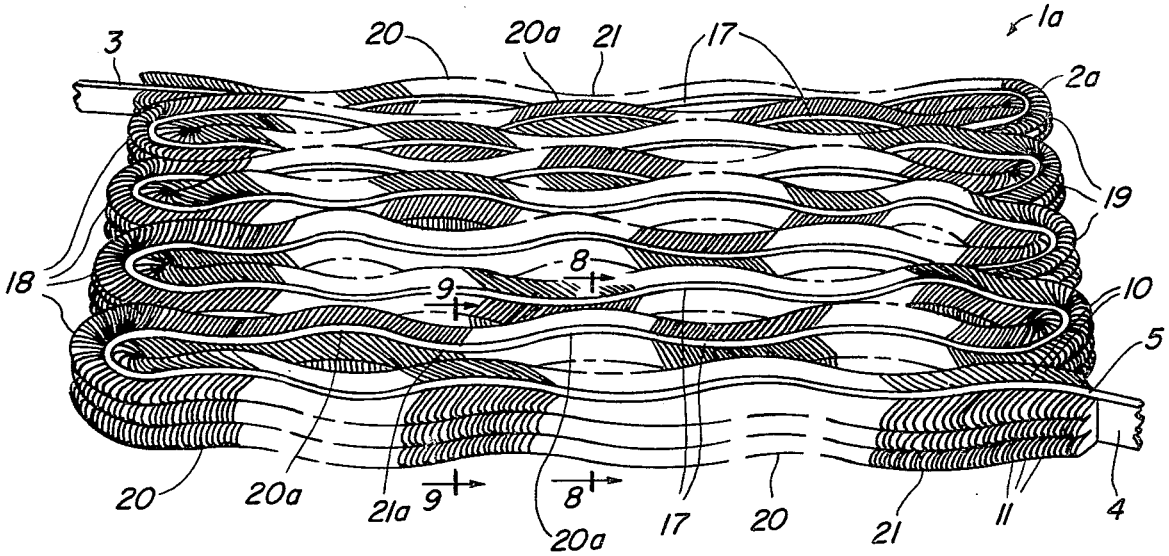
FIG. 7 is a perspective view, similar to FIG. 1, showing a modified form of the present invention.
Figure 8:
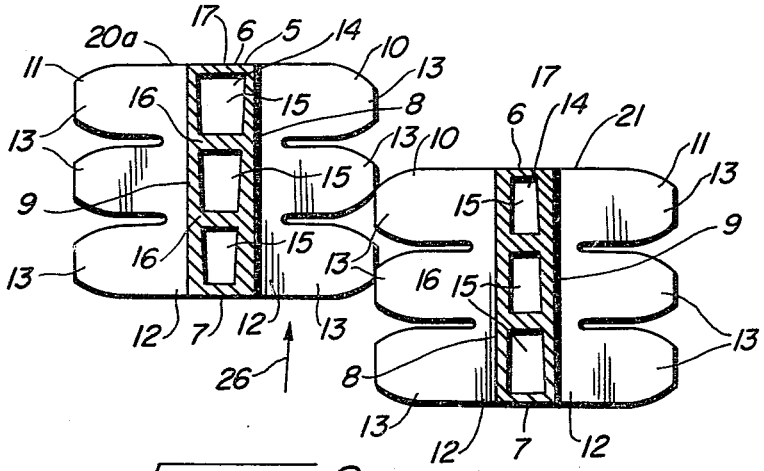
FIG. 8 is a detail sectional view taken substantially along the line 8—8 in FIG. 7.
Figure 9:
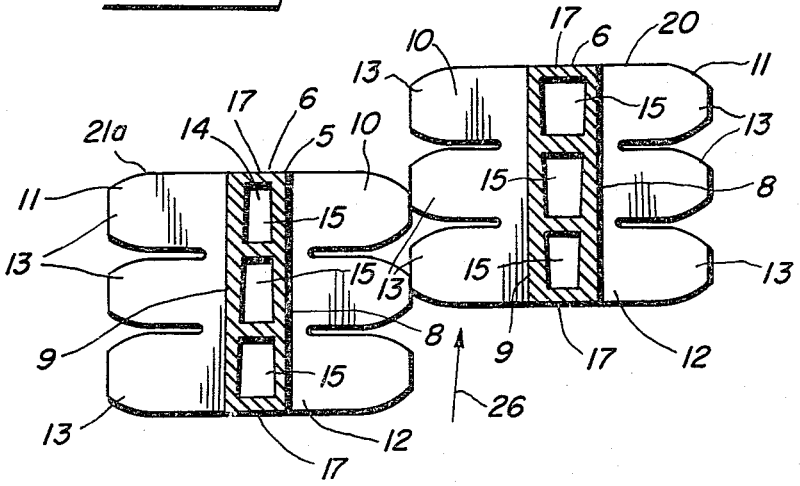
FIG. 9 is a detail sectional view taken substantially along the line 9—9 in FIG. 7.

In FIGS. 7–9 of the drawings, a modified form of the present invention is shown, and parts which are the same as parts shown in FIGS. 1–6 are indicated by the same reference numerals, and parts which are similar to parts shown in FIGS. 1–6 are indicated by the same reference numerals with the suffix "a;38 added thereto.

The heat exchanger 1*a* shown in the drawings is indentical in construction to the heat exchanger 1 except that aligned undulations 20 and aligned undulations 21 are not formed in all of the passes 17. In the heat exchanger 1*a*, alternate ones or every other one of the passes 17 have aligned undulations 20 and aligned undulations 21. The other passes 17, have undulations 20*a* and 21*a* that are aligned with each other but not with the undulations 20 and 21, the undulations 20*a* and 21*a* being aligned with the spaces between adjacent undulations 20 and 21, respectively, on the first mentioned alternate passes 17, FIG. 7. Preferably, the undulations 20, 21, 20*a* and 21*a* are all of the same size and the centers of the undulations 20 and 21 are aligned with the spaces between the undulations 20*a* and 21*a*, respectively, mid-way thereof.

As a result of the aforementioned construction, a "basket weave" type of appearance is afforded in the heat exchanger 1*a*, with the convex-upwardly undulations 20*a*, as viewed in FIG. 7, being disposed adjacent to convex downwardly undulations 21 as shown in FIG. 8, and with the convex downwardly convolutions 21*a* being disposed adjacent to convex upwardly undulations 20, as shown in FIG. 9.

In the presently preferred method of forming the heat exchanger 1*a*, the finned tubular member 2*a* may first be formed in straight form and then bent into a serpentine shape, as shown in FIG. 7, in the same manner as heretofore discussed with respect to the tubular member 2. Thereafter, the undulations 20 and 21 and the undulations 20*a* and 21*a*, on respective alternate passes 17 may be formed in the same manner as heretofore discussed with respect to the heat exchanger 1.

With this construction, at the respective opposite lateral faces of the heat exchanger 1*a*, the fins 10 and 11 on the undulations 20*a* project further outwardly, or in an upward direction as viewed in FIG. 7, than the fins 10 and 11 on the adjacent undulations 21, as shown in FIG. 8; and the fins 10 and 11 on the undulations 21*a* project further laterally outwardly, in a downward direction, as viewed in FIG. 7, than the fins 10 and 11 on the adjacent undulations 20, as shown in FIG. 9. With this construction, the restriction to air flow laterally through the heat exchanger 1*a* is reduced, as compared to the restriction to air flow through a heat exchanger 1 of the same size, the adjacent fins 10 and 11 on adjacent passes 17, in the heat exchanger 1*a*, being off-set relative to each other so that air entering the concave sides of the undulations has a shorter passage through the heat exchanger 1*a* before it can escape from between the adjacent fins 10 or 11. Thus, for example, air entering the undulations 20*a* and 20 in the direction of the arrows 26, shown in FIGS. 8 and 9, respectively, may escape from between the fins 10 on the convolutions 20*a* and 20 not only from the upper ends of the passageways 22, as viewed in FIGS. 8 and 9, but laterally outwardly therefrom from those portions of the passageways 22 defined by the fins 10 on the undulations 20*a* and 20, which are disposed above the fins 10 on the undulations 21 and 21*a*, as viewed in FIGS. 8 and 9, respectively.

In FIGS. 10–14 of the drawings, another modified form of the present invention is shown, and parts thereof which are the same as parts shown in FIGS. 1–6 are indicated by the same reference numerals, and parts which are similar to parts shown in FIGS. 1–6 are indicated by the same reference numerals with the suffix "b" added thereto.

Figure 10:
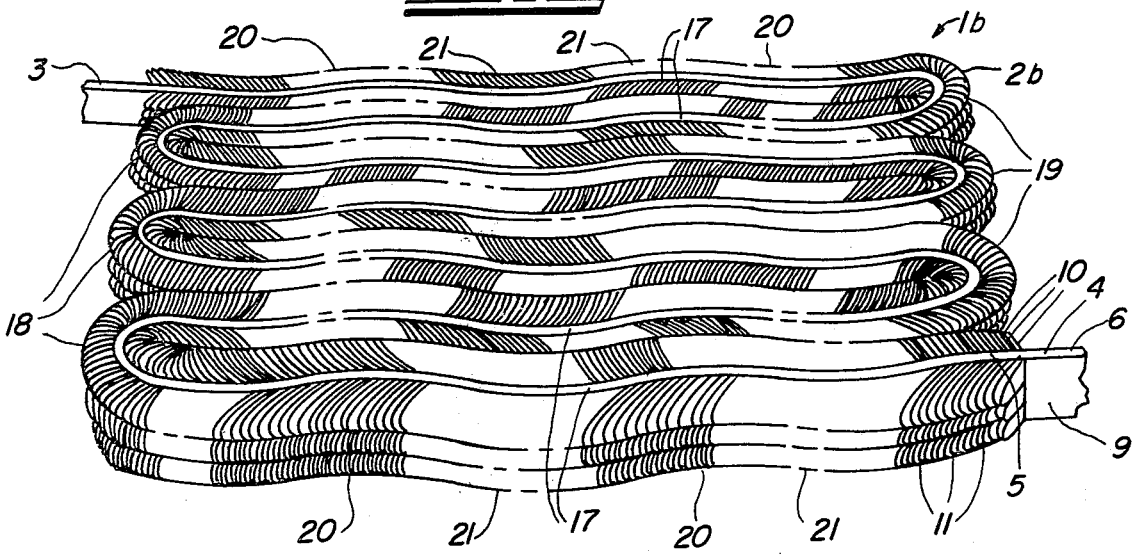
FIG. 10 is a perspective view, similar to FIG. 1, showing another modified form of the present invention.
Figure 11:
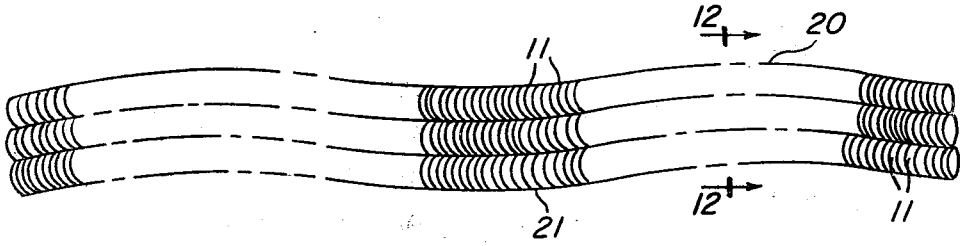
FIG. 11 is a fragmentary, side elevational view of the heat exchanger shown in FIG. 10.
Figure 12:
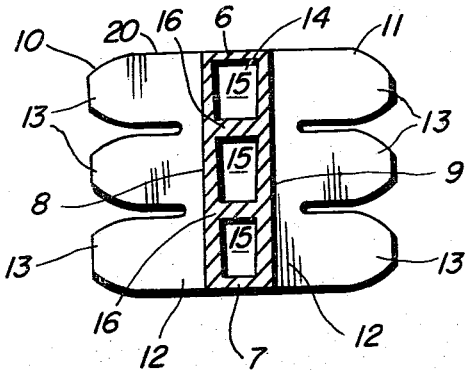
FIG. 12 is a detail sectional view taken substantially along the line 12—12 in FIG. 11.

The heat exchanger 1*b* shown in FIG. 10 is identical in construction to the heat exchanger 1, shown in FIG. 1, except that, as will be discussed in greater detail hereinafter, the fins 10 and 11 are formed on the tubular member 2*b* after the undulations 20 and 21 are formed in the passes 17, and are disposed in parallel relation to each other on each of the passes 17.

In the presently preferred method of forming the heat exchanger 1*b*, the tubular member 2*b* is first formed as an elongated, substantially straight tubular member without fins disposed thereon, the tubular member 2*b* then embodying the conduit portion 5 having the aforementioned two narrower opposite side walls 6 and 7 interconnected by the opposite side walls 8 and 9. Thereafter, with no fins having been formed on the tubular member 2*b*, as yet, the undulations 20 and 21 are formed therein in the direction of the spacing of the narrower side walls 6 and 7 from each other. Preferably, the undulations 20 and 21 are formed in the tubular member 2*b* in the same manner as heretofore discussed with respect to the forming of the undulations 20 and 21 in the tubular member 2, shown in FIG. 1, except that in the present operation, the ends of the tubular member 2*b* preferably are free to move inwardly toward each other, during the formation of the undulations 20 and 21.

Thereafter, the fins 10 and 11 are formed on the side walls 8 and 9 of the tubular member 2*b*. Preferably, the fins 10 and 11 are formed on the tubular member 2*b* by cutting or gouging them out of the side walls 8 and 9, respectively, of the conduit 5 of the tubular member 2*b* in the manner disclosed in the aforementioned U.S. Pat. No. 3,692,105, in substantially the same manner as that discussed with respect to forming the fins 10 and 11 on the tubular member 2, except, in this instance, the conduit 5 is undulating in form and the fins 10 and 11 are cut from the side walls 8 and 9, respectively, in a straight path transversely to the undulations 20 and 21. Preferably, the fins 10 and 11 are so formed on the tubular member 2*b* that they are disposed in spaced, parallel relation to each other thoughout the length of the tubular member 2*b*.

With the tubular member 2*b* thus having the external fins 10 and 11 thereon, and having the undulations 20 and 21 therein, the conduit portion 5 thereof is then bent back and forth upon itself around the side walls 8 and 9, respectively, to afford the body portion of the heat exchanger 1*b* in the form of the aforementioned serpentine-shaped, externally-finned tubular member 2*b*. In this latter form of the body portion 2*b*, it embodies a plurality of passes or conduit members 17 disposed in side-by-side, substantially parallel relation to each other with return bends 18 and 19 interconnecting adjacent ends of adjacent ones of the passes 17 at respective opposite ends of the latter, as in the body portion 2 of the heat exchanger 1, shown in FIG. 1. However, unlike the body portion 2 of the heat exchanger 1, the fins 10 and 11 on the body portion 2*b* of the heat exchanger 1*b* are disposed in parallel relation to each other on the walls 8 and 9, respectively, throughout the length of the passes 17 thereof.

Figure 13:
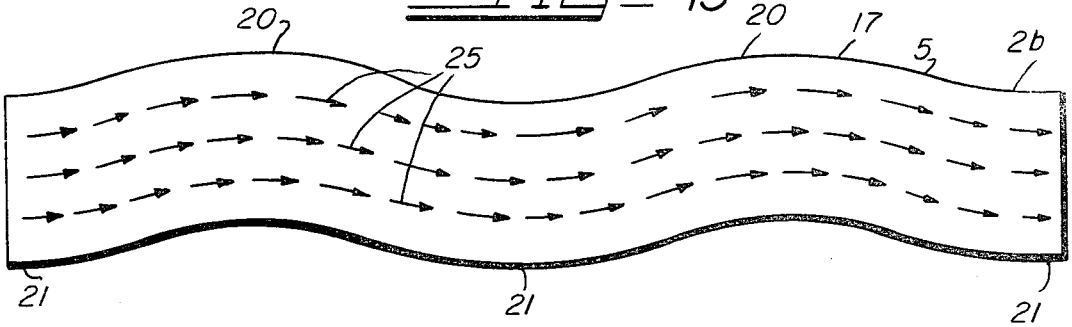
FIG. 13 is a diagrammatic view, similar to FIG. 6, illustrating the flow paths of fluid longitudinally through the heat exchanger shown in FIG. 10.

With the heat exchanger 1*b* constructed in the aforementioned manner, the flow of working fluid through the passageway 15 in the passes 17 is in an undulating path, as diagrammatically illustrated by the arrows 25 in FIG. 13, in the same manner as the flow of working fluid through the heat exchanger 1, as heretofore discussed. However, the fins 10 and 11 are disposed in parallel relation to each other, as diagrammatically illustrated in FIG. 14, so that the passageways 22*b* therebetween are parallel to each other and each is of uniform width throughout its length.

With this construction, turbulence is imparted to the working fluid passing through the passageways 15 of the heat exchanger 1*b*, and the working fluid engages the side walls of the passageways 15 with a wiping contact in the same manner as heretofore discussed with respect to the passage of working fluid through the passageways 15 of the heat exchanger 1. However, the passage of external working fluid, such as, for example, air, through the passageways 22*b* being in a straight-line manner, the passageways 22*b* parallel to each other, and the adjacent fins 10 or 11 defining the respective passageways 22*b* being parallel to each other, the resistance to the passage of such external working fluid through the heat exchanger 1*b* is less than the resistance to the passage of working fluid through the passageways 22 of the heat exchanger 1.

Figure 15:
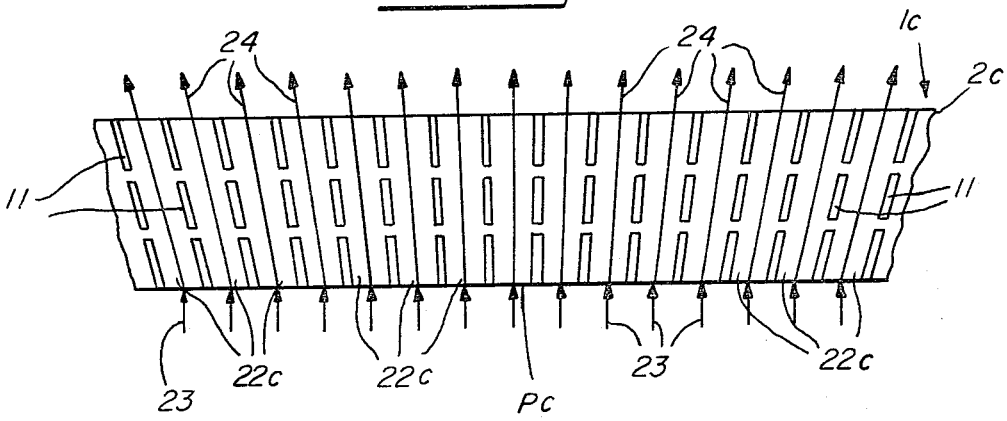
FIG. 15 is a diagrammatic view, similar to FIG. 14, showing a further modified form of the present invention.

In FIG. 15 of the drawings, another modified form of the present invention is shown, and parts which are the same as parts shown in FIGS. 1–6 are indicated by the same reference numerals, and parts which are similar to parts shown in FIGS. 1–6 are indicated by the same reference numerals with the suffix "c" added thereto.

In the preferred method of affording the tubular member 2*c*, shown in FIG. 15, the heretofore described method of forming the undulating, externally-finned tubular member 2*b*, shown in FIGS. 10–14 may first be used, and, then, prior to bending the same into the serpentine form shown in FIG. 10, another operation may be performed on the tubular member 2*c* either prior to or in place of the aforementioned serpentine bending thereof, to thereby readily dispose the passageways 22*c* at varying angles to each other, as shown in FIG. 15.

Figure 14:
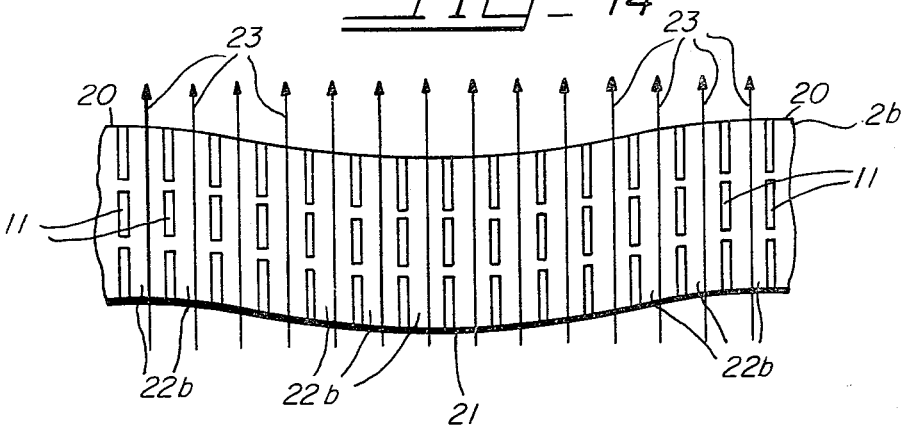
FIG. 14 is a diagrammatic view, similar to FIG. 5, illustrating the position of the external fins, of the heat exchanger shown in FIG. 10, relative to each other with respect to their positions along the undulations in the tubular member of the heat exchanger shown in FIG. 10.

In this additional, or other operation of the preferred practice of the form of the invention shown in FIG. 15, the undulations in the tubular member 2*c* corresponding to the undulations 20 and 21 in the tubular member 2, shown in FIGS. 10–14, are straightened, to thereby transform the tubular member 2*c* from the undulating form of the tubular member 2*b*, shown in FIG. 14, to the substantially straight form shown in FIG. 15. As a result of this operation, the fins 10 and 11 of the tubular member 2*c*, which were parallel to each other in the undulating form thereof, corresponding to the tubular member 2*b*, as illustrated with respect to the fins 11 in FIG. 14, are now disposed in progressively outwardly diverging angles to each other from the respective portions of the tubular member 2*c* which previously constituted the longitudinal center portions of the respective undulations 20 and 21 thereof. Thus, for example, assuming that the area Pc shown in FIG. 15 is the centermost portion of a previously formed undulation 21, corresponding to the undulation 21 shown in FIG. 14, the fins 10 and 11 at opposite sides of this portion of the straightened tubular member 2*c* are disposed at oppositely opening, progressively increasing, acute angles to the portion Pb at opposite sides thereof throughout the length of the portion of the tubular member 2*c* which previously constituted the undulation 21, not shown. The same is true, of course, with respect to the portions of the tubular member 2*c* which previously constituted the respective undulating portions 20 thereof, not shown, except that the adjacent fins open outwardly at downwardly opening acute angles rather than upwardly opening acute angles, as viewed in FIG. 15.

With this construction of the tubular member 2*c*, the passage of working fluid longitudinally therethrough will be in a straight line direction, and not in an undulating path, such as the paths 25 through which the working fluid passes in flowing longitudinally through the tubular members of the forms of the invention shown in FIGS. 1–14. As a result, the resistance to the passage of fluid longitudinally through the tubular member 2*c* is less than the resistance to the passage of fluid longitudinally through the tubular member 2*a* or 2*b*.

However, like the passage of air, or the like, across the exterior of the tubular member 2, in the form of the invention shown in FIGS. 1–6, the air entering the heat exchanger 1*c* in a direction perpendicular thereto, as illustrated by the arrows 23 in FIG. 15, is deflected at an acute angle to that perpendicular direction during its passage through all of the passageways 22*c*, except those passageways 22*c* that may happen to be disposed exactly at what was previously the center of a respective undulation 20 or 21, as illustrated by the arrows 24 in FIG. 15. As a result, a turbulence is set up in the air passing through these offset passageways 22*c*, and the air passing through these passageways 22*c* is caused to impinge against the fins 10 or 11 defining the respective passageways, and to contact these fins with a wiping action, in a manner similar to that heretofore discussed with respect to the heat exchanger 1.

If desired, after forming the straightened tubular member 2*c*, shown in FIG. 15, it may be bent back and forth upon itself, around the side walls 8 and 9, into a serpentine pattern, such as that shown in FIG. 10, but, of course, in this latter form of the heat exchanger 1*c*, the passes 17 thereof would not be undulating in form but would be disposed in substantially straight, parallel relation to each other.

On the other hand, as was true with respect to the heat exchanger 1, shown in FIGS. 1–6, other forms of construction, embodying the tubular member 2*c*, may be afforded without departing from the purview of the broader aspects of the present invention. For example, a heat exchanger embodying suitable headers, not shown, with passes 17 constituting individual conduit members, made from the tubular member 2*c*, extending between and connected into the headers could be afforded, or a heat exchanger embodying only one, substantially straight tubular member, embodying the construction of the tubular member 2*c* could be so afforded.

From the foregoing it will be seen that the present invention affords novel heat exchangers.

Also, it will be seen that the present invention affords novel methods for making heat exchangers.

In addition, it will be seen that the present invention affords novel heat exchangers which are practical and efficient in operation and which may be readily and economically produced commercially.

Thus, while I have illustrated and described the preferred embodiments of my invention, it is to be understood that these are capable of variation and modification, and I therefore do not wish to be limited to the precise details set forth, but desire to avail myself of such changes and alterations as fall within the purview of the following claims.

I claim:

1. A heat transfer element comprising a. an elongated conduit having a passageway for working fluid extending longitudinally therethrough, b. a plurality of fins disposed in spaced relation to each other (1) longitudinally of said conduit, (2) on two oppositely disposed sides of the latter c. said fins on each of said sides projecting outwardly away from said fins on the other of said sides, d. adjacent ones of said fins on each of said sides defining a passageway therebetween e. said conduit having a plurality of longitudinally extending undulations, projecting in opposite directions relative to the longitudinal axis of said conduit, f. said undulations being in a direction relative to the length of said conduit transverse to the direction said two sides of said conduit are disposed relative to each other, g. certain of said passageways on each of said sides being disposed substantially perpendicular to the length of said conduit, and h. passageways on opposite sides of said certain passageways being disposed in progressively oppositely diverging angles to said certain passageways.

2. A heat transfer element as defined in claim 1, and in which a. said fins on each of said sides are integral to said conduit.

3. A heat transfer element as defined in claim 1, and in which a. said fins on each of said sides embody (1) a base portion integral to said conduit and projecting outwardly therefrom, and (2) a plurality of spines integral to each of said base portions and projecting outwardly therefrom, and b. said spines on each of said base portions project outwardly from said conduit substantially the same distance.

4. A heat transfer element as defined in claim 1, and in which a. said fins on each of said sides are integral to said conduit, and b. said conduit has internal wall means dividing said first mentioned passageway into a plurality of passageways extending longitudinally through said conduit in side-by-side relation to each other, and said plurality of passageways are off-set from each other in the direction of the undulating of said undulations.

5. A heat transfer element as defined in claim 4, and in which a. the one of said last mentioned passageways which is disposed on the outside of a respective one of said undulations has a larger cross-sectional area than the one of said last mentioned passageways which is disposed on the inside of said respective one undulation.

6. A heat transfer element comprising a. an elongated conduit having a passageway for working fluid extending longitudinally therethrough, and b. a plurality of fins projecting outwardly from two oppositely disposed sides of said conduit, c. said conduit having two other substantially smooth sides spaced from each other transversely to the spacing of said first mentioned two sides, d. said conduit having undulations extending longitudinally thereof, e. said undulations undulating substantially in the direction that said substantially smooth sides are spaced from each other.

7. A heat transfer element as defined in claim 6, and in which a. said conduit is bent back and forth in a series of return bends into a serpentine pattern, and b. said return bends are made in the direction of the spacing of said two first mentioned sides from each other.

8. A heat transfer element as defined in claim 6 or claim 7, and in which a. said fins on each of said sides (1) are spaced from each other longitudinally of said conduit, and (2) comprise elongated members extending longitudinally across said first mentioned sides transversely to the length of the latter.

9. A heat transfer element as defined in claim 6 or claim 7, and in which a. said fins on each of said first mentioned sides (1) are spaced from each other longitudinally of said conduit, and (2) comprise elongated members extending longitudinally across said first mentioned sides transversely to the length of the latter, and b. adjacent fins on each of said first mentioned sides define therebetween a passageway extending transversely across said side for the passage of air therethrough, and c. individual ones of said undulations have a plurality of said passageways extending transversely thereacross, and d. said passageways on each of said individual ones of said undulations, which are disposed on opposite sides of the center-most disposed passageway on said undulation, are disposed in progressively greater, oppositely disposed angles to said center-most passageway longitudinally of said conduit.

10. A heat transfer element comprising a. a plurality of elongated conduit members disposed in substantially parallel relation to each other
b. each of said members having a passageway for working fluid extending longitudinally therethrough,
c. means interconnecting said passageways in adjacent ends of adjacent ones of said members, and
d. a plurality of fins projecting outwardly from two oppositely disposed sides of each of said members,
e. said members having two other sides spaced from each other transversely to the spacing of said first mentioned two sides,
f. each of said conduits having a plurality of undulations extending longitudinally thereof,
g. said undulations undulating substantially in the direction that said other sides are spaced from each other.

11. A heat transfer element as defined in claim 10, and in which
a. said members are disposed in position wherein the sides of adjacent ones of said members, which face each other, are said first mentioned sides.

12. A heat transfer element as defined in claim 11, and in which
a. said undulations on each of said members are aligned with corresponding undulations on other of said members.

13. A heat transfer element as defined in claim 11, and in which
a. said undulations on each of said members are aligned with corresponding undulations on all of the other of said members.

14. A heat transfer element as defined in claim 11, and in which
a. said undulations on alternate ones of said member are aligned with corresponding undulations on the other of said alternate members, and
b. said undulations on the remaining ones of said members are aligned with the spaces between adjacent pairs of said undulations on said alternate members.

15. A heat transfer element comprising
a. an elongated conduit having a passageway for working fluid extending longitudinally therethrough,
b. said conduit being substantially serpentine in shape and having
(1) a plurality of substantially parallel passes, and
(2) a plurality of return bends interconnecting adjacent ends of respective adjacent pairs of said passes, and
c. a plurality of fins projecting outwardly from said passes,
d. said fins on each of said passes
(1) being spaced from each other longitudinally of the latter, and
(2) projecting therefrom in a direction substantially uniplanar to the direction of the spacing of said passes relative to each other,
e. said passes having undulations extending longitudinally thereof,
f. said undulations undulating in a direction transverse to the direction of spacing between said passes.

16. A heat transfer element as defined in claim 15, and in which
a. each of said passes has a plurality of said undulations along the length thereof.

17. A heat transfer element as defined in claim 16, and in which
a. each of said undulations on each of said passes is substantially aligned, axially of the arc thereof, with a corresponding undulation on an adjacent one of said passes.

18. A heat transfer element as defined in claim 16, and in which
a. said undulations are so disposed on said passes that said undulations on adjacent ones of said passes are so disposed relative to each other that the axis of the arc of respective ones of said undulations on one of said passes of said adjacent ones of said passes is disposed in non-aligned, parallel relation to and between the axes of the arcs of adjacent ones of said undulations on the other of said adjacent ones of said passes.

19. A heat transfer element as defined in claim 16, and in which
a. said undulations are so disposed on said passes that
(1) each of said undulations on alternate ones of said passes is substantially aligned, axially of the arc thereof, with a corresponding undulation on an adjacent one of said alternate passes, and
(2) said undulations on the other of said passes, disposed between said alternate ones of said passes, are so disposed on said other passes that
(a) each of said undulations on each of said other passes is substantially aligned, axially of the arc thereof, with a corresponding undulation on an adjacent one of said other passes, and
(b) the axis of the arc of each of said undulations on said other pass is disposed
(1') in substantially parallel relation to the arc axes of undulations on the same side of said alternate undulations, and
(2') spaced, longitudinally of said passes, substantially one half the length of one of said undulations from the next of said axis parallel thereto.

20. A heat transfer element as defined in claim 17 or 19, and in which
a. said passes
(1) are substantially rectangular in transverse cross-sectional shape and
(2) have
(a) two oppositely disposed narrower faces, and
(b) two oppositely disposed wider faces, and
b. said fins project from said wider faces and are integral therewith, and
c. said narrower faces are substantially smooth, and
d. said conduit has wall means dividing said first mentioned passageway into a plurality of passageways extending longitudinally therethrough, and
e. said plurality of passageways are spaced from each other between said narrower faces in a direction substantially in parallel relation to said wider faces, and
f. said passageway in each of said undulations, whch is closest to the outside of said undulation, is larger in cross-sectional size than said passageway in said last mentioned undulation, which is disposed closest to the inside of said last mentioned undulation.

21. A heat transfer element comprising
a. an elongated conduit portion having
(1) a passageway for working fluid extending longitudinally therethrough,
(2) two substantially axially aligned opposite end portions,
(3) an intermediate portion disposed between said end portions,
b. a plurality of fins disposed on said intermediate portion in spaced relation to each other
(1) longitudinally of said conduit,
(2) on two oppositely disposed sides of the latter c. said fins on each of said sides projecting outwardly away from said fins on the other of said sides,
d. adjacent ones of said fins on each of said sides defining a passageway therebetween,
e. said intermediate portion being undulant in a direction relative to the longitudinal axis of said end portions transverse to the direction said two sides of said conduit are disposed relative to each other.

22. A heat transfer element comprising
a. an elongated conduit having a passageway for working fluid extending longitudinally therethrough, and
b. a plurality of fins disposed in spaced relation to each other
(1) longitudinally of said conduit,
(2) on two oppositely disposed sides of the latter
c. said fins on each of said sides projecting outwardly away from said fins on the other of said sides,
d. adjacent ones of said fins on each of said sides
(1) being disposed in substantially parallel relation to each other, and
(2) defining a passageway therebetween, and
e. said portion of said conduit having said fins thereon being undulant in a direction relative to the length of said conduit transverse to the direction said two sides of said conduit are disposed relative to each other.

23. A heat transfer element as defined in claim 22, and in which
a. said fins on each of said sides are integral to said conduit.

24. A heat transfer element as defined in claim 22, and in which
a. said fins on each of said sides embody
(1) a base portion integral to said conduit and projecting outwardly therefrom, and
(2) a plurality of spines integral to each of said base portions and projecting outwardly therefrom.

25. A heat exchanger as defined in claim 23, and in which
a. said conduit has a plurality of longitudinally extending undulations projecting in opposite directions relative to each other.

26. A heat transfer element comprising
a. an elongated conduit having a passageway for working fluid extending longitudinally therethrough, and
b. said conduit having
(1) two substantially smooth, oppositely disposed sides, and
(2) two other sides spaced from each other transversely to the spacing of said first mentioned two sides
c. said conduit having undulations extending longitudinally thereof, and
d. said undulations undulating substantially in the direction that said substantially smooth sides are spaced from each other, and
e. a plurality of elongated fins
(1) projecting outwardly from said other sides on said undulations, and
(2) extending transversely across said conduit in substantially parallel spaced relation to each other.

27. A heat transfer element as defined in claim 26, and in which
a. said conduit is bent back and forth in a series of return bends into a serpentine pattern, and
b. said return bends are made in the direction of the spacing of said other sides from each other.

28. A heat exchanger as defined in claim 11, and in which
a. said fins comprise elongated members extending across said undulations in spaced, substantially parallel relation to each other.

29. A heat transfer element comprising
a. an elongated substantially straight conduit having a passageway for working fluid extending longitudinally therethrough, and
b. a plurality of elongated fins disposed in spaced relation to each other
(1) longitudinally of said conduit,
(2) on two oppositely disposed sides of the latter
c. said fins on each of said sides extending laterally thereacross and projecting outwardly away from said fins on the other of said sides, and
d. adjacent pairs of said fins along each of said sides being disposed at progressively changing angles relative to each other.

30. A heat transfer element as defined in claim 29, and in which
a. said fins on each of said sides are integral to said conduit.

31. A heat transfer element as defined in claim 29, and in which
a. said fins on each of said sides embody
(1) a base portion integral to said conduit and projecting outwardly therefrom, and
(2) a plurality of spines integral to each of said base portions and projecting outwardly therefrom.

32. A heat transfer element comprising
a. an elongated conduit having a passageway for working fluid extending longitudinally therethrough,
b. said conduit having
(1) a plurality of substantially straight portions disposed in parallel relation to each other, and
(2) means interconnecting said passageway at adjacent ends of said straight portions at each end of the latter, and
c. a plurality of elongated fins extending transversely across said portions
(1) in spaced relation to each other longitudinally of said portions, and
(2) on two oppositely disposed sides of the latter,
d. said fins on each of said sides projecting outwardly away from said fins on the other of said sides,
e. said sides are the sides of said portions that are disposed in facing relation to each other, and
f. adjacent ones of said fins on sections of said portions being disposed at progressively changing angles to each other from the longitudinal center areas of said sections toward the ends thereof longitudinally of said portions.

33. A heat transfer element as defined in claim 32, and in which
a. each of said portions has a plurality of said sections disposed along said respective portion.

* * * * *